US010984695B2

(12) United States Patent
Xiong et al.

(10) Patent No.: US 10,984,695 B2
(45) Date of Patent: Apr. 20, 2021

(54) DISPLAY DRIVING DEVICE AND DISPLAY DRIVING METHOD FOR CONTROLLING CHARGING TIME OF PIXEL CIRCUIT, AND DISPLAY DEVICE

(71) Applicants: Hefei BOE Display Technology Co., Ltd., Anhui (CN); BOE TECHNOLOGY GROUP CO., LTD., Beijing (CN)

(72) Inventors: Yulong Xiong, Beijing (CN); Liugang Zhou, Beijing (CN); Tao Li, Beijing (CN); Yizhan Han, Beijing (CN); Jianwei Sun, Beijing (CN); Liu He, Beijing (CN)

(73) Assignees: Hefei BOE Display Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/543,125

(22) Filed: Aug. 16, 2019

(65) Prior Publication Data

US 2020/0234622 A1 Jul. 23, 2020

(30) Foreign Application Priority Data

Jan. 18, 2019 (CN) ..... 201910049855.6

(51) Int. Cl.
*G09G 3/20* (2006.01)

(52) U.S. Cl.
CPC ..... *G09G 3/20* (2013.01); *G09G 2310/027* (2013.01); *G09G 2310/0267* (2013.01)

(58) Field of Classification Search
CPC ..... G09G 3/20; G09G 2310/0267; G09G 2310/027
See application file for complete search history.

(56) References Cited

U.S. PATENT DOCUMENTS

2008/0079001 A1* 4/2008 Umezaki ..... H01L 27/1251 257/59
2018/0337687 A1* 11/2018 Adjiwibawa ..... H03M 1/662

* cited by examiner

*Primary Examiner* — Lisa S Landis
(74) *Attorney, Agent, or Firm* — Arch & Lake LLP

(57) ABSTRACT

A display driving device is disclosed. The display driving device includes: a data signal end for providing a data signal, a source line, and a switching circuit. The source line can transmit the data signal to a first pixel circuit and a second pixel circuit. Along a direction of the source line, a distance between the second pixel circuit and the data signal end is larger than a distance between the first pixel circuit and the data signal end. The switching circuit is between the data signal end and the source line, and can be turned on in response to a first control signal, and can be turned on in response to a second control signal. A turned-on time period of the switching circuit in response to the second control signal is longer than a turned-on time period of the switching circuit in response to the first control signal.

15 Claims, 9 Drawing Sheets

DISPLAY DRIVING DEVICE AND DISPLAY DRIVING METHOD FOR CONTROLLING CHARGING TIME OF PIXEL CIRCUIT, AND DISPLAY DEVICE

CROSS-REFERENCE

This application is based upon and claims priority to Chinese Patent Application No. 201910049855.6, filed on Jan. 18, 2019, the entire contents thereof are incorporated herein by reference.

TECHNICAL FIELD

The present disclosure relates to the field of display technologies, in particular, relates to a display driving device, a display driving method, and a display device.

BACKGROUND

Generally, in a display device, a pixel driving circuit is used to drive the display device to display a screen. A timing control module in the pixel driving circuit outputs a data signal and a scan signal. In the driving process, the pixel circuits are scanned row by row under the control of the scan signal, and the data signal is sent to each row through the source line to charge the capacitor corresponding to each row of pixels of the pixel circuit.

In practical applications, due to the different distances of the pixel circuits from the timing control module, the data signal is attenuated due to circuit load and the like in the process of transmitting the data signal to the capacitor corresponding to the pixel far from the timing control module, especially in a large-sized panel, for example, in a TV panel of 65 inches or more. The attenuation of the data signal causes the capacitor of the pixel circuit in a row at a far end is charged insufficiently, thus affecting the uniformity of panel charging.

It should be noted that the information disclosed in the Background section above is only for understanding of the background of the present disclosure, and thus may include information that does not constitute prior art known to those of ordinary skill in the art.

SUMMARY

According to a first aspect of the present disclosure, there is provided a display driving device. The display driving device includes a data signal end for providing a data signal. The display driving device includes a source line configured to transmit the data signal to a first pixel circuit and a second pixel circuit. Along a direction of the source line, a distance between the second pixel circuit and the data signal end is larger than a distance between the first pixel circuit and the data signal end. The display driving device includes a switching circuit disposed between the data signal end and the source line, and configured to be turned on in response to a first control signal in a charging phase of the first pixel circuit, and to be turned on in response to a second control signal in a charging phase of the second pixel circuit. A turned-on time period of the switching circuit in response to the second control signal is longer than a turned-on time period of the switching circuit in response to the first control signal.

According to an arrangement of the present disclosure, the first pixel circuit is coupled to a first pixel unit, and the second pixel circuit is coupled to a second pixel unit.

According to an arrangement of the present disclosure, the first pixel circuit is turned on upon receipt of a first scan signal. The second pixel circuit is turned on upon receipt of a second scan signal. A time interval between a triggering edge of the second control signal and a triggering edge of the second scan signal is smaller than a time interval between a triggering edge of the first control signal and a triggering edge of the first scan signal. The triggering edge of the second control signal is later than the triggering edge of the second scan signal. The triggering edge of the first control signal is later than the triggering edge of the first scan signal.

According to an arrangement of the present disclosure, a duration of a non-effective level of the first control signal is the same as a duration of a non-effective level of the second control signal.

According to an arrangement of the present disclosure, a time interval between a starting edge of a non-effective level of the second control signal and a triggering edge of the second scan signal is equal to a time interval between a starting edge of a non-effective level of the first control signal and a triggering edge of the first scan signal, and a duration of a non-effective level of the second control signal is shorter than a duration of a non-effective level of the first control signal.

According to an arrangement of the present disclosure, the first pixel circuit is coupled to a plurality of first pixel units, and the second pixel circuit is coupled to a plurality of second pixel units.

According to an arrangement of the present disclosure, the plurality of first pixel units are arranged one by one sequentially along the source line, and the plurality of second pixel units are arranged one by one sequentially along the source line.

According to an arrangement of the present disclosure, the number of the second pixel units coupled to the second pixel circuit is less than or equal to the number of the first pixel units coupled to the first pixel circuit.

According to an arrangement of the present disclosure, the display driving device further includes a control circuit coupled to the switching circuit, and configured to output the first control signal and the second control signal.

According to an arrangement of the present disclosure, the switching circuit includes a transistor having a first end coupled to the data signal end, a second end coupled to the source line, and a control end coupled to the control circuit.

According to an arrangement of the present disclosure, the transistor is an N-type thin film transistor or a P-type thin film transistor.

According to a second aspect of the present disclosure, there is provided a display driving method. The method includes receiving a first control signal, so that the switching circuit is turned on and the first pixel circuit coupled to the source line is charged with the data signal. The method includes receiving a second control signal, so that the switching circuit is turned on and the second pixel circuit coupled to the source line is charged with the data signal. A distance between the second pixel circuit and the data signal end is larger than a distance between the first pixel circuit and the data signal end along a direction of the source line, and a turned-on time period of the switching circuit in response to the second control signal is longer than a turned-on time period of the switching circuit in response to the first control signal.

According to a third aspect of the present disclosure, there is provided a display device including the display driving device described above.

The above general description and the following detailed description are intended to be illustrative and not restrictive.

BRIEF DESCRIPTION OF THE DRAWINGS

Arrangements of the present disclosure shall be discussed below with reference to the accompanying drawings.

DETAILED DESCRIPTION

Figure 1:
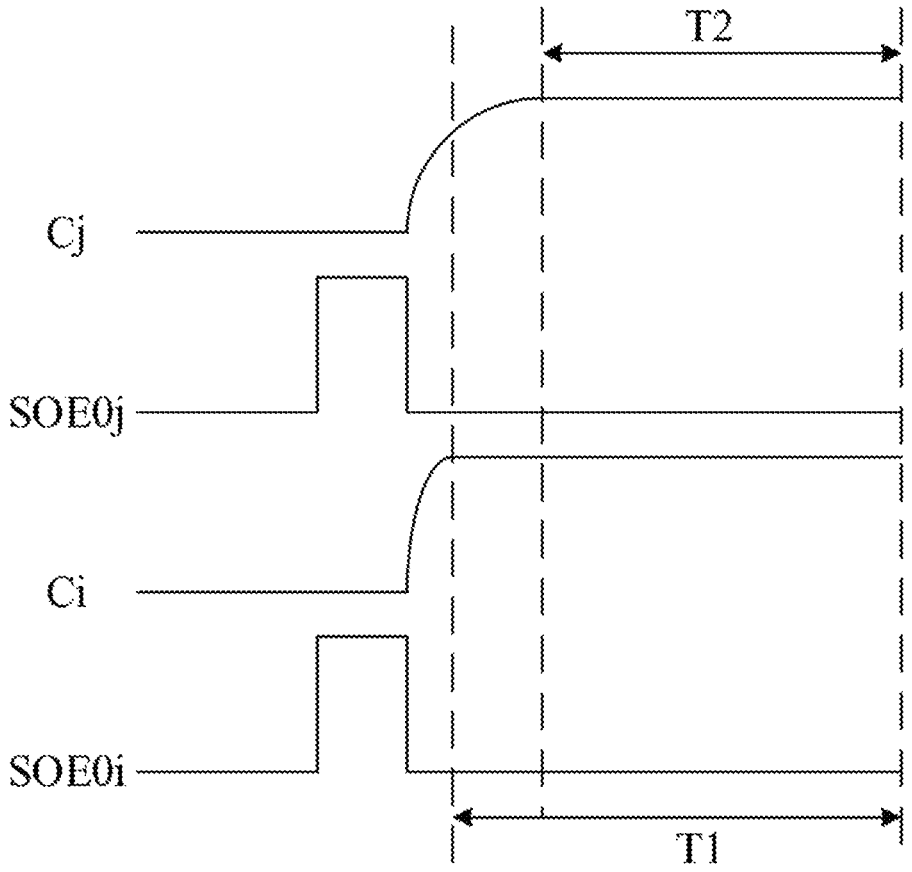
FIG. 1 is a schematic diagram of charging of a pixel circuit according to the related art.

Example arrangements will now be described more fully with reference to the accompanying drawings. However, the exemplary arrangements can be embodied in a variety of forms and should not be construed as being limited to the arrangements set forth herein. Rather, these arrangements are provided to make the present disclosure more fully and complete, and to fully convey the concept of the exemplary arrangements to those skilled in the art. The same reference numerals in the drawings denote the same or similar parts, and the repeated description thereof will be omitted.

Furthermore, the described features, structures, or characteristics may be combined in any suitable manner in one or more arrangements. In the following description, numerous specific details are set forth to provide thorough understanding of the arrangements of the present disclosure. However, one skilled in the art will appreciate that the technical solution of the present disclosure may be practiced without one or more of the specific details, or other methods, components, materials, devices, blocks, etc. may be employed. In other instances, well-known structures, methods, devices, implementations, materials, or operations are not shown or described in detail to avoid obscuring aspects of the present disclosure.

The block diagrams shown in the figures are merely functional entities and do not necessarily have to correspond to physically separate entities. That is, these functional entities may be implemented in software, or these functional entities or a part thereof may be implemented in one or more software-hardened modules, or these functional entities may be implemented in different networks and/or processor devices and/or microcontroller devices.

The large-size 4K display panel, especially the TV panel of 65 inches or more, has a large load in the pixel circuit at a far end row, which causes the effective charging time period at near end with respect to the data signal end in the display panel be different from the effective charging time period at the far end. When charging at the far end, the data signal passes through a large circuit load, and the effective charging time period for the pixel is short. When charging at the near end, the data signal passes through a small circuit load, and the effective charging time period for the pixel is long. As shown in FIG. 1, under the control of the control signals SOE0*i* and SOE0*j*, the near-end row charging curve is shown as Ci in the figure and has an effective charging time period T1, and the far-end row charging curve is shown as Cj in the figure and has an effective charging time period T2. The near-end effective charging time period is longer than the far-end effective charging time period. For some special screens, there will be defects such as horizontal fine stripes, which seriously affects the display quality of the panel.

In the related art, the method for solving the problem of horizontal fine stripes is to row over-driving. The principle is to over-drive the next row of data for compensation according to a difference between gray scales of the upper and lower rows in display, to make up for the insufficient charging of the next row of data. For example, the N-th row displays in gray scale 0, the (N+1)-th row displays in gray scale 127, if no compensation is used, the actual charging level of the (N+1)-th row will not reach the gray scale 127, which may be gray scale 110, resulting in insufficient charging. If row over-driving compensation is used, the data output by the (N+1)-th row timing controller will not be gray scale 127, and may be gray scale 140 to compensate for the insufficient charging of the (N+1)-th row, so that the (N+1)-th row displays approximately in gray scale 127. With the row over-driving, row over-driving compensation is performed on the data by the timing controller, so that the pixel displays in approximately the desired gray scale. The gray scale in which the pixel actually displays is still different from the desired gray scale, and if the pixel is required to display in a high gray scale, such as 255, it cannot be over driven. Therefore, the over-driving method has limited space to be improved.

Figure 2:
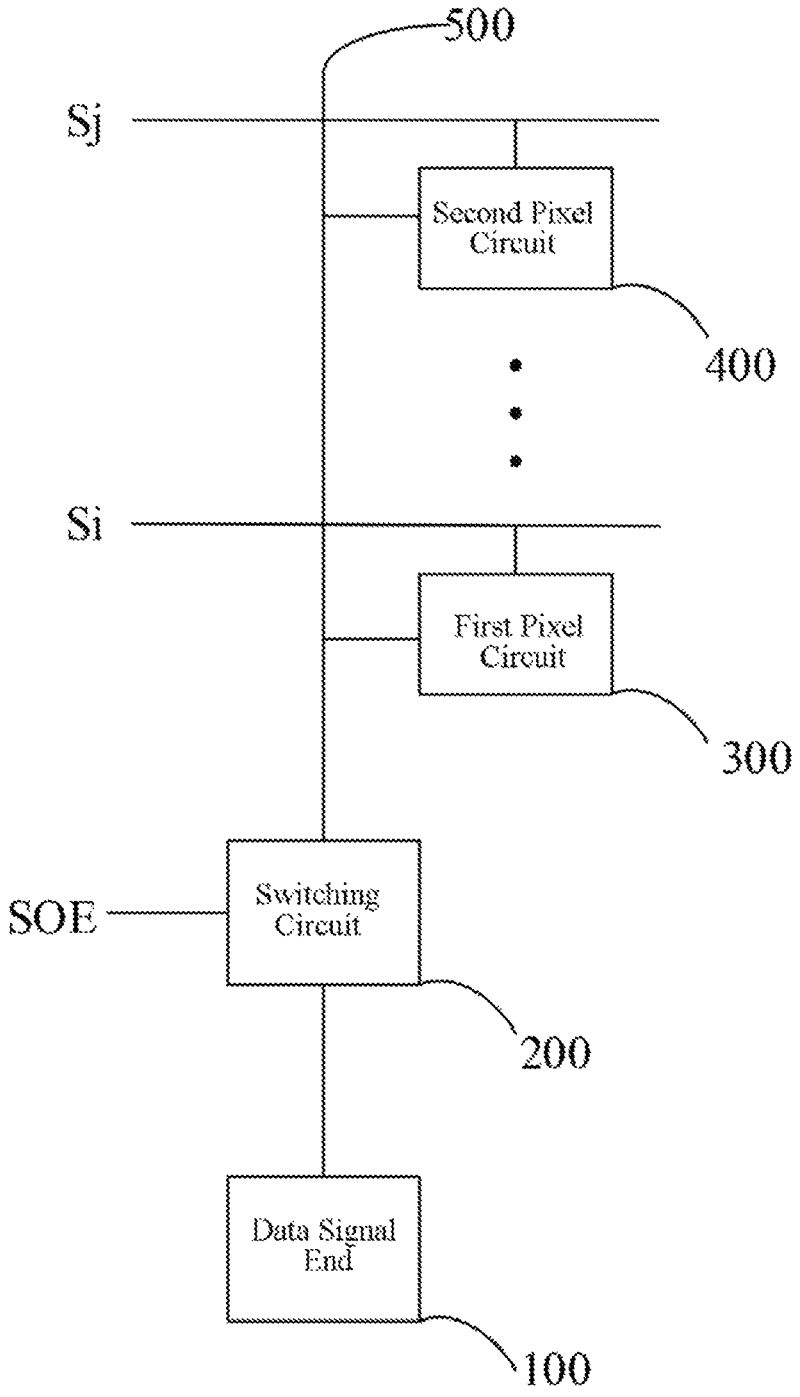
FIG. 2 is a schematic diagram of a display driving device according to an exemplary arrangement of the present disclosure.

An exemplary arrangement of the present disclosure first provides a display driving device, as shown in FIG. 2. The display driving device includes a data signal end 100, a source line 500, and a switching circuit 200.

The data signal end 100 is configured to provide a data signal.

The source line 500 is configured to transmit the data signal to a first pixel circuit 300 and a second pixel circuit 400. Along a direction of the source line 500, a distance between the second pixel circuit 400 and the data signal end 100 is larger than a distance between the first pixel circuit 300 and the data signal end 100.

The switching circuit 200 is disposed between the data signal end 100 and the source line 500, and is configured to be turned on in response to a first control signal SOEi in a charging phase of the first pixel circuit 300, and to be turned on in response to a second control signal SOEj in a charging phase of the second pixel circuit 400. A turned-on time period of the switching circuit 200 in response to the second control signal SOEj is longer than a turned-on time period of the switching circuit 200 in response to the first control signal SOEi.

The display driving device according to the present disclosure controls the switching circuit 200 to be turned on during the charging phase of the first pixel circuit 300 under control of the first control signal SOEi, and controls the switching circuit 200 to be turned on during the charging phase of the second pixel circuit 400 under control of the second control signal SOEj. Since along the direction of the source line 500, a distance between the second pixel circuit 400 and the data signal end 100 is larger than a distance between the first pixel circuit 300 and the data signal end 100, and a turned-on time period of the switching circuit 200 in response to the second control signal SOEj is longer than a turned-on time period of the switching circuit 200 in response to the first control signal SOEi, that is, the charging time period of the second pixel circuit 400 at the far end to the data signal end 100 is longer than the charging time period of the first pixel circuit 300 at the near end. Thus, it can solve the problem that the pixel circuit capacitance in a row at the far end is insufficiently charged due to the attenuation of the data signal, thus affecting the uniformity of panel charging, and can improve the display quality.

It should be noted that the first pixel circuit 300 in the arrangement of the present disclosure refers to any one or more rows of pixel circuits in the pixel circuit of the display panel, and the second pixel circuit 400 refers to any one or more rows of pixel circuits which has a distance to the data signal end 100 larger than the distance between the first pixel circuit 300 to the data signal end 100 in the pixel circuit of the display panel. The charging phase of the first pixel circuit 300 refers to a phase in which the first pixel circuit 300 is turned on in response to a first scan signal, and the charging phase of the second pixel circuit 400 refers to a phase in which the second pixel circuit 400 is turned on in response to a second scan signal.

In a possible implementation according to the arrangement of the present disclosure, the first pixel circuit 300 is coupled to one first pixel unit, and the second pixel circuit 400 is coupled to one second pixel unit. That is, the charging time period of the storage capacitor in the pixel circuit of each pixel unit can be controlled separately according to its distance to the data signal end 100 along the direction of the source line 500. In turn, the problem of insufficient charging at the far end can be solved. The first pixel circuit 300 and the second pixel circuit 400 may be pixel circuits in adjacent rows, respectively, or may be pixel circuits in rows not adjacent to each other, which are not specifically limited in the arrangement of the present disclosure.

Figure 3:
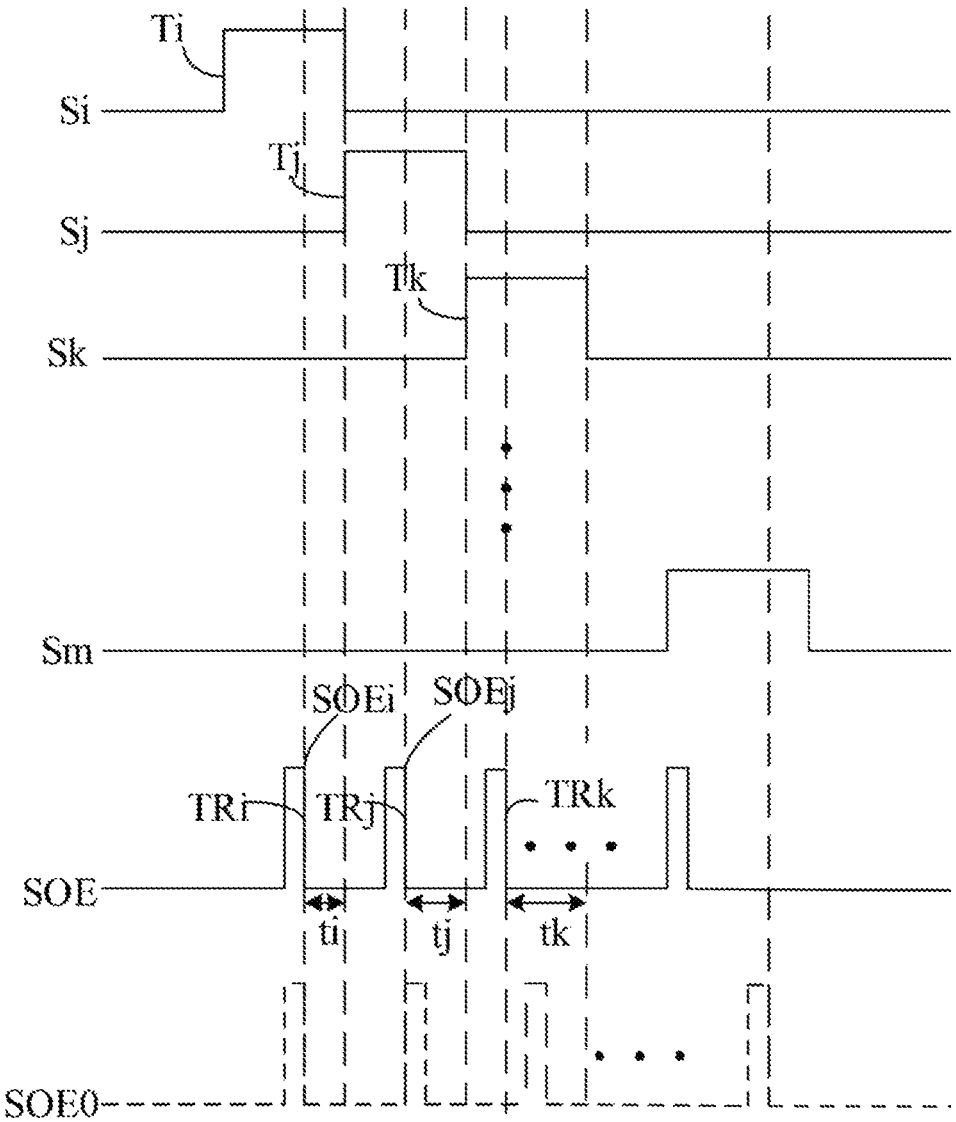
FIG. 3 is a driving timing diagram according to an exemplary arrangement of the present disclosure.

In the display driving process, as shown in FIG. 3, the first pixel circuit 300 is turned on upon receipt of the first scan signal, and the second pixel circuit 400 is turned on upon receipt of the second scan signal. A time interval between a triggering edge TRj of the second control signal SOEj and a triggering edge Tj of the second scan signal Sj is smaller than a time interval between a triggering edge Tri of the first control signal SOEi and a triggering edge Ti of the first scan signal Si. The triggering edge TRj of the second control signal SOEj is later than the triggering edge Tj of the second scan signal Sj, and the triggering edge Tri of the first control signal SOEi is later than the triggering edge Ti of the first scan signal. By making the triggering edge of the control signal SOE at the far end arrive earlier in the scan period, the turned-on time period of the switching circuit 200 can be extended in the scan period for the far end, such that the effective charging time period of the pixel circuit at the far end is the same as the effective charging time period of the pixel circuit at the near end. Similarly, for the a third scan signal Sk at a farther end, a time interval between a triggering edge TRk of the third control signal SOEk and a triggering edge Tk of the third scan signal Sk is smaller than the time interval between a triggering edge TRj of the second control signal SOEj and a triggering edge Tj of the second scan signal Sj.

On the one hand, as shown in FIG. 3, a duration of a non-effective level of the first control signal SOEi is the same as a duration of a non-effective level of the second control signal SOEj. The control signal SOE includes an effective level and a non-effective level, the non-effective level and the effective level are distinguished by the triggering edge, and the durations of the non-effective levels of the first control signal SOEi and the second control signal SOEj are the same. For example, the switching circuit 200 is turned on at a low level, and in this case, the high level is a non-effective level, and the falling edge of the signal is a triggering edge. In this case, the durations of the high levels of the first control signal SOEi and the second control signal SOEj are the same. Of course, in the practical applications, the switching circuit 200 can also be turned on at a high level. In this case, the non-effective level is a low level, and the triggering edge is a rising edge of the signal. The arrangement of the present disclosure is not limited thereto.

Figure 4:
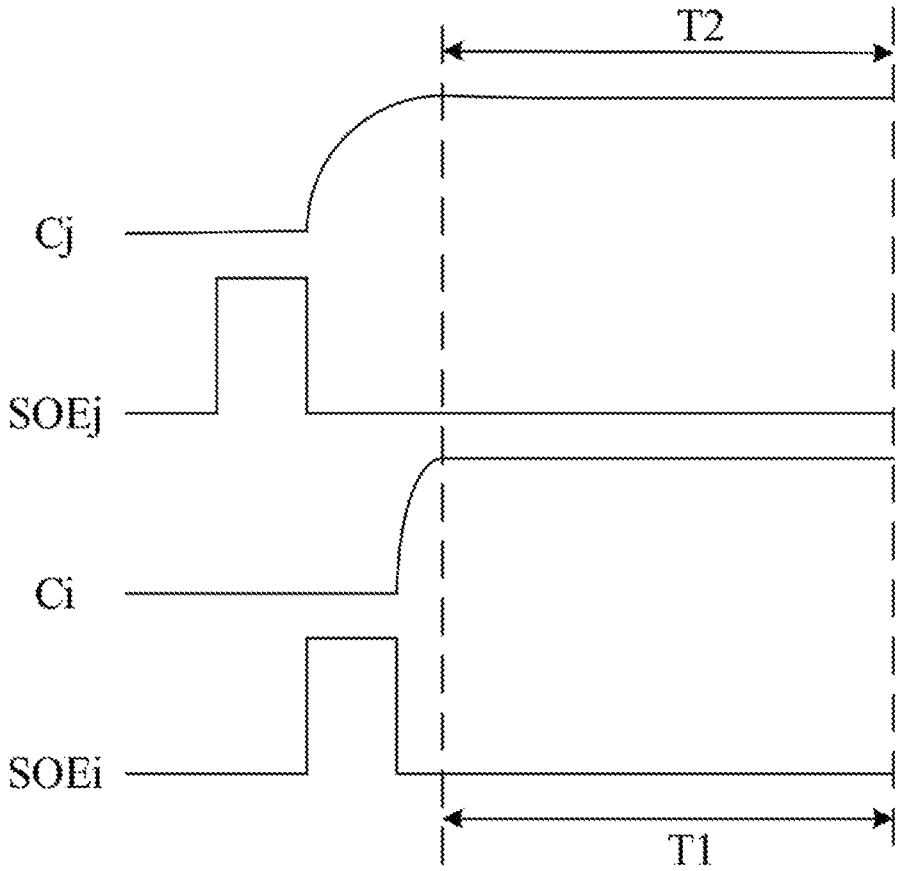
FIG. 4 is a schematic diagram of charging of a pixel circuit according to an exemplary arrangement of the present disclosure.

In FIG. 3, SOE0 is a waveform diagram of a comparison control signal, and by comparing the waveforms, it can be seen that a duration tj of the effective level of the second control signal SOEj is longer than a duration ti of the effective level of first control signal SOEi, such that the turned-on time period of the switching circuit 200 in the period of the second san signal Sj is longer than the turned-on time period of the switching circuit 200 in the period of the first san signal Si. Therefore, the effective charging time periods of the first pixel circuit 300 and the second pixel circuit 400 are the same. As shown in FIG. 4, under the control of the control signals SOEi and SOEj, a charging curve for the near-end row is shown as Ci in the figure, which has an effective charging time period Ti, and the charging curve for the far-end row is shown as Cj in the figure, which has an effective charging time period T2. The effective charging time period of the near end is the same as the effective charging time period of the far end.

Figure 5:
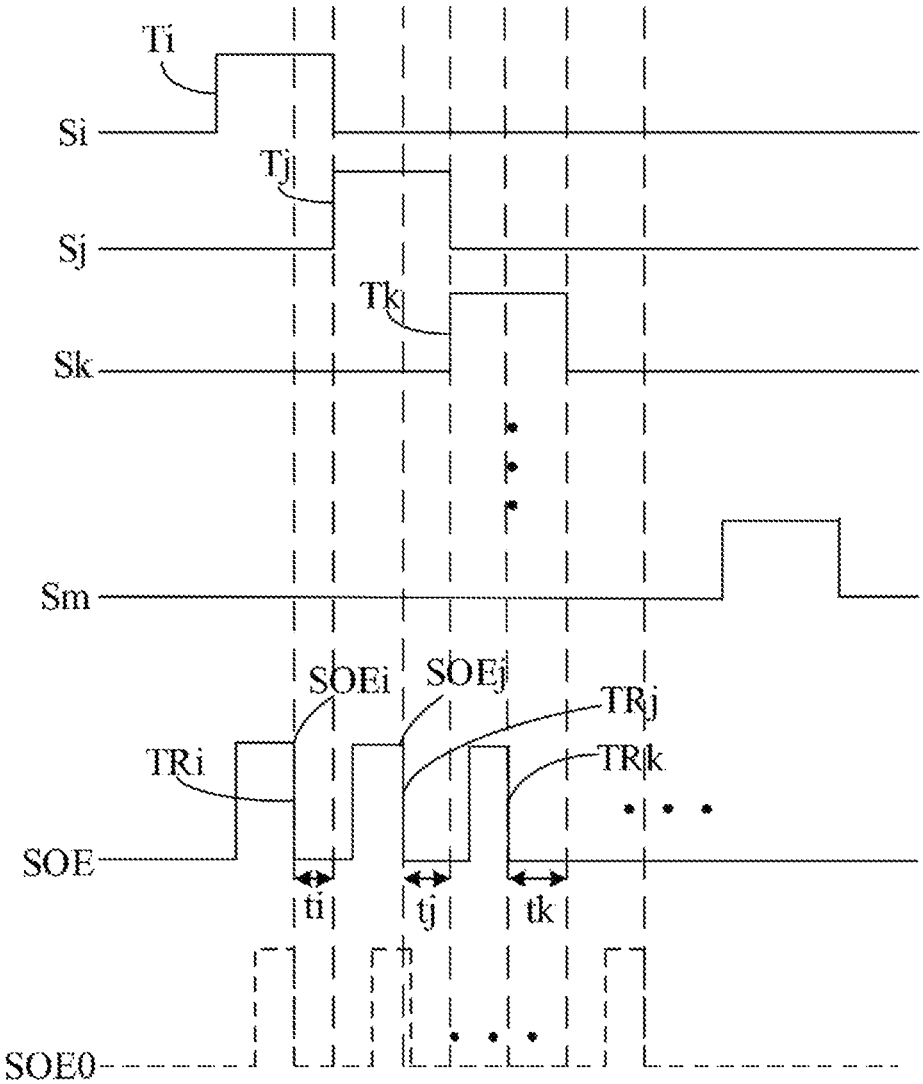
FIG. 5 is another driving timing diagram according to an exemplary arrangement of the present disclosure.

On the other hand, as shown in FIG. 5, a time interval between a starting edge of a non-effective level of the second control signal SOEj and a triggering edge of the second scan signal is equal to a time interval between a starting edge of a non-effective level of the first control signal SOEi and a triggering edge of the first scan signal, and a duration of a non-effective level of the second control signal SOEj is shorter than the duration of the non-effective level of the first control signal SOEi. By reducing the duration of the non-effective level of the second control signal SOEj, the duration of the effective level of the second control signal SOEj is increased, and the turned-on time period of the switching circuit 200 during the charging phase of the second pixel circuit 400 is increased, so that the effective charging time period of the pixel circuit at the far end is the same as the effective charging time period of the pixel circuit at the near end.

Figure 6:
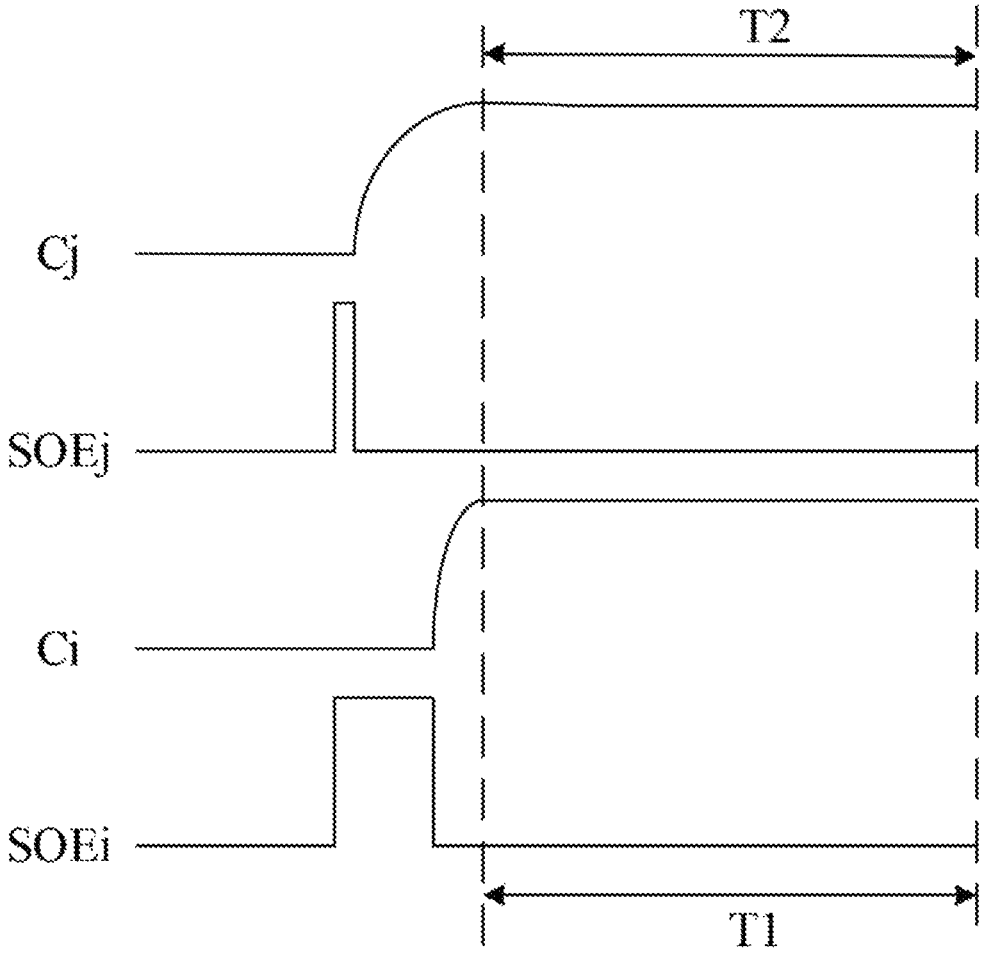
FIG. 6 is a schematic diagram of charging of another pixel circuit according to an exemplary arrangement of the present disclosure.

In FIG. 5, SOE0 is a waveform diagram of a comparison control signal, and by comparing the waveforms, it can be seen that a duration of the non-effective level of the second control signal SOEj is shorter than a duration of the non-effective level of first control signal SOEi, and a duration of the effective level of the second control signal SOEj is longer than a duration of the effective level of first control signal SOEi, such that the turned-on time period tj of the switching circuit 200 in the period of the second san signal Sj is longer than the turned-on time period ti of the switching circuit 200 in the period of the first san signal Si. Therefore, the effective charging time periods of the first pixel circuit 300 and the second pixel circuit 400 are the same. As shown in FIG. 6, under the control of the control signals SOEi and SOEj, a charging curve for the near-end row is shown as Ci in the figure, which has an effective charging time period Ti, and the charging curve for the far-end row is shown as Cj in the figure, which has an effective charging time period T2. The effective charging time period of the near end is the same as the effective charging time period of the far end. The effective charging time period described in the arrangement of the present disclosure may be an effective charging time period for the storage capacitor in the pixel circuit.

Figure 7:
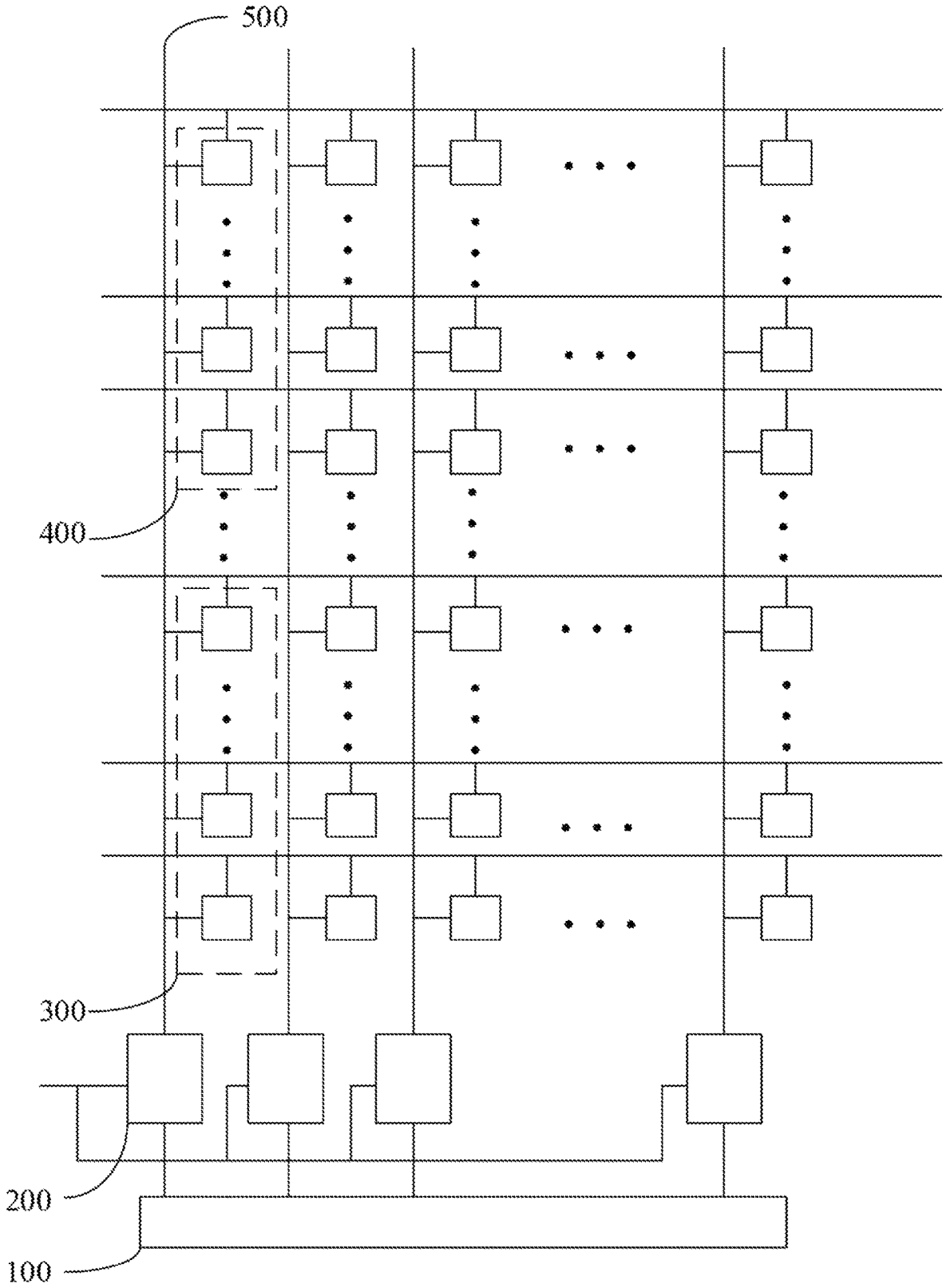
FIG. 7 is a schematic diagram of another display driving device according to an exemplary arrangement of the present disclosure.

In a possible implementation according to the arrangement of the present disclosure, as shown in FIG. 7, the first pixel circuit 300 is coupled to a plurality of first pixel units, and the second pixel circuit 400 is coupled to a plurality of second pixel units.

When the first pixel circuit 300 is coupled to one first pixel unit, and the second pixel circuit 400 is coupled to one second pixel unit, scanning each row of pixel circuits requires a different control signal SOE, which causes the control signals SOE to be more complicated. In order to simplify the control signals SOE, a plurality of areas can be divided, and an area includes a plurality of rows of pixel circuits. For example, the display panel can be divided into a near-end area and a far-end area. During the scanning of the near-end area, the switching circuit 200 is turned on for a first time period under control of the first control signal SOEi in the process of scanning each row; during the scanning of the far-end area, the switching circuit 200 is turned on for a second time period under control of the second control signal SOEj in the process of scanning each row; and the second time period is longer than the first time period. Thus, it can solve the problem of insufficient charging of the pixel circuit at the far end, and also can simplify the control signal, and make it easy to be implemented.

When the first pixel circuit 300 is coupled to a plurality of first pixel units, and the second pixel circuit 400 is coupled to a plurality of second pixel units, the plurality of the first pixel units are arranged one by one sequentially along the source line 500, and the plurality of second pixel units are arranged one by one sequentially along the source line 500. That is, when the display panel is divided into areas, the areas are consecutive, and the pixel units in each area do not intersect with each other.

Since the attenuation of the data signal to the far end is more serious, in order to better charge the far-end pixel circuit, the number of the second pixel units coupled to the second pixel circuit 400 is less than or equal to the number of the first pixel units coupled to the first pixel circuit 300.

For example, a display driving device shown in FIG. 7 includes M×N pixel units, M rows of gate lines coupled to the control end of the pixel circuit, and N columns of source lines coupled to the input ends of the pixel circuits. The switching circuits respectively control the source lines to supply data signals to the pixel circuits. Depending on the distance between the gate line and the data signal end, the switching circuit is turned on according to the timing control, to supply the data signal to the pixel circuit.

Further, the display driving device may further include a control circuit, and the control circuit is coupled to the switching circuit 200 to output the first control signal SOEi and the second control signal SOEj.

A counter can be provided in the controller to count the number of rows scanned during the scanning process. For example, starting from the near end, every time the counter counts a time, the triggering edge of the control signal is advanced by a predetermined time, so that the turned-on time period of the switching circuit 200 increases progressively during the row-by-row scanning process.

The switching circuit 200 can include a transistor having a first end coupled to the data signal end 100, a second end coupled to the source line 500, and a control terminal coupled to the control circuit. The transistor is turned on in response to the control signal SOE output by the control circuit, to transmit the data signal to the source line 500.

The transistor is an N-type thin film transistor or a P-type thin film transistor. When the transistor is an N-type thin film transistor, the switching circuit 200 is turned on at a high level, and turned off at a low level, and the rising edge of the control signal SOE is a triggering edge. When the transistor is a P-type thin film transistor, the switching circuit 200 is turned on at a low level, and turned off at a high level, and the falling edge of the control signal SOE is the triggering edge.

Figure 8:
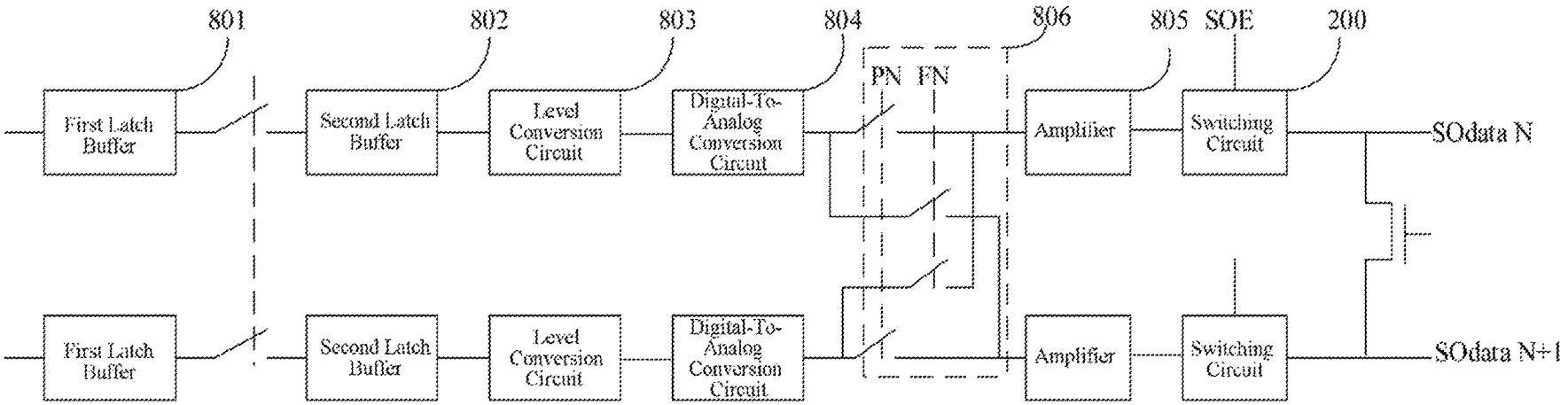
FIG. 8 is a schematic diagram of a source signal input device according to an exemplary arrangement of the present disclosure.

In practical applications, as shown in FIG. 8, the data signal output by the timing controller is stored in a first latch buffer 801. When a valid latch signal is received, the data signal is transmitted from the first latch buffer 801 to a second latch buffer 802, then transmitted to the data signal end 100 via a level conversion circuit 803, a digital-to-analog conversion circuit 804, and an amplification circuit 805. The data signal end 100 is coupled to the switching circuit 200. A polarity inversion switch 806 is provided between the digital-to-analog conversion circuit 804 and the amplification circuit 805. Since the polarity of the data signals of the adjacent two rows is opposite, the polarity inversion switch 806 is configured to switch the two rows of data signals such that the polarity of the output data signal is inverted.

It should be noted that although several modules or units of the display driving device are mentioned in the above detailed description, such division is not mandatory. In fact, in accordance with arrangements of the present disclosure, the features and functions of two or more modules or units described above may be embodied in one module or unit. On the other hand, the features and functions of one module or unit described above may be further divided into multiple modules or units.

Figure 9:
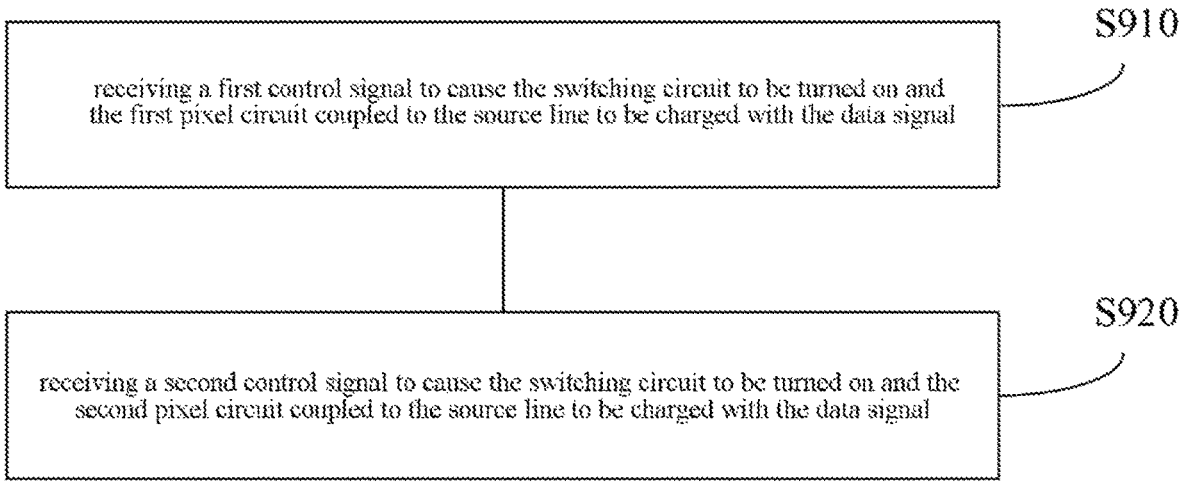
FIG. 9 is a flowchart of a display driving method according to an exemplary arrangement of the present disclosure.

An exemplary arrangement of the present disclosure further provides a display driving method for the above display driving device. As shown in FIG. 9, the display driving method includes the following blocks.

In block 5910, a first control signal is received, to cause the switching circuit to be turned on and the first pixel circuit coupled to the source line to be charged with a data signal.

In block 5920, a second control signal is received, to cause the switching circuit to be turned on and the second pixel circuit coupled to the source line to be charged with a data signal.

Along a direction of the source line, a distance between the second pixel circuit and the data signal end is larger than a distance between the first pixel circuit and the data signal end, and a turned-on time period of the switching circuit in response to the second control signal is longer than a turned-on time period of the switching circuit in response to the first control signal.

The specific details of the blocks in the above display driving method have been described in detail with respect to the corresponding display driving device, and thus will not be described herein.

It should be noted that, although the various blocks of the method of the present disclosure are described in a particular order in the drawings, this does not require or imply that the blocks must be performed in the specific order, or that all the blocks shown must be performed to achieve the desired results. Additionally or alternatively, certain blocks may be omitted, multiple blocks being combined into one block execution, and/or one block being decomposed into multiple block and the like.

An exemplary arrangement of the present disclosure also provides a display device including the display driving device described above. Of course, in the actual application, the display device may further include a backlight module, a display module, and the like, as they are all belong to the prior art, the details thereof will be omitted in the arrangements of the present disclosure. The display device may include, for example, a mobile phone, a tablet computer, a television, a notebook computer, a digital photo frame, a navigator, or the like, any product or component having a display function.

Those skilled in the art will appreciate that various aspects of the present disclosure can be implemented as a system, a method, or a program product. Accordingly, aspects of the present disclosure may be embodied in the form of a complete hardware arrangement, a complete software arrangement (including firmware, microcode, etc.), or a combination of hardware and software aspects, which may be collectively referred to herein as "a circuit," "a module," or "a system."

Further, the above-described drawings are merely illustrative of the processes included in the method according to the exemplary arrangements of the present disclosure, and are not intended to be limiting. It is easy to understand that the processing shown in the above drawings does not indicate or limit the chronological order of these processes. In addition, it is also easy to understand that these processes may be performed synchronously or asynchronously, for example, in a plurality of modules.

Other arrangements of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the disclosure only be limited by the appended claims.

What is claimed is:

1. A display driving device, comprising:

a data signal end configured to provide a data signal;

a source line configured to transmit the data signal to a first pixel circuit and a second pixel circuit, wherein along a direction of the source line, a distance between the second pixel circuit and the data signal end is larger than a distance between the first pixel circuit and the data signal end; and a switching circuit disposed between the data signal end and the source line, and configured to be turned on in response to a first control signal in a charging phase of the first pixel circuit, and to be turned on in response to a second control signal in a charging phase of the second pixel circuit, wherein a turned-on time period of the switching circuit in response to the second control signal is longer than a turned-on time period of the switching circuit in response to the first control signal, wherein the first pixel circuit is coupled to one first pixel unit, and the second pixel circuit is coupled to one second pixel unit, and wherein the first pixel circuit is turned on upon receipt of a first scan signal, and the second pixel circuit is turned on upon receipt of a second scan signal, a time interval between a triggering edge of the second control signal and a triggering edge of the second scan signal is smaller than a time interval between a triggering edge of the first control signal and a triggering edge of the first scan signal, the triggering edge of the second control signal is later than the triggering edge of the second scan signal, and the triggering edge of the first control signal is later than the triggering edge of the first scan signal.

2. The display driving device according to claim 1, wherein a duration of a non-effective level of the first control signal is the same as a duration of a non-effective level of the second control signal.

3. The display driving device according to claim 1, wherein a time interval between a time interval between a starting edge of a non-effective level of the second control signal and the triggering edge of the second scan signal is equal to a time interval between a starting edge of a non-effective level of the first control signal and the triggering edge of the first scan signal.

4. The display driving device according to claim 1, wherein the first pixel circuit is coupled to a plurality of first pixel units, and the second pixel circuit is coupled to a plurality of second pixel units.

5. The display driving device according to claim 4, wherein the plurality of first pixel units are arranged one by one sequentially along the source line, and the plurality of second pixel units are arranged one by one sequentially along the source line.

6. The display driving device according to claim 5, wherein a number of the second pixel units coupled to the second pixel circuit is less than or equal to a number of the first pixel units coupled to the first pixel circuit.

7. The display driving device according to claim 1, further comprising:

a control circuit coupled to the switching circuit, and configured to output the first control signal and the second control signal.

8. The display driving device according to claim 7, wherein the switching circuit comprises:

a transistor having a first end coupled to the data signal end, a second end coupled to the source line, and a control end coupled to the control circuit.

9. The display driving device according to claim 8, wherein the transistor is one of an N-type thin film transistor and a P-type thin film transistor.

10. A display device comprising a display driving device, wherein the display driving device comprises:

a data signal end configured to provide a data signal;

a source line configured to transmit the data signal to a first pixel circuit and a second pixel circuit, wherein along a direction of the source line, a distance between the second pixel circuit and the data signal end is larger than a distance between the first pixel circuit and the data signal end; and a switching circuit disposed between the data signal end and the source line, and configured to be turned on in response to a first control signal in a charging phase of the first pixel circuit, and to be turned on in response to a second control signal in a charging phase of the second pixel circuit, wherein a turned-on time period of the switching circuit in response to the second control signal is longer than a turned-on time period of the switching circuit in response to the first control signal, wherein the first pixel circuit is coupled to one first pixel unit, and the second pixel circuit is coupled to one second pixel unit, and wherein the first pixel circuit is turned on upon receipt of a first scan signal, and the second pixel circuit is turned on upon receipt of a second scan signal, a time interval between a triggering edge of the second control signal and a triggering edge of the second scan signal is smaller than a time interval between a triggering edge of the first control signal and a triggering edge of the first scan signal, the triggering edge of the second control signal is later than the triggering edge of the second scan signal, and the triggering edge of the first control signal is later than the triggering edge of the first scan signal.

11. The display device according to claim 10, wherein a duration of a non-effective level of the first control signal is the same as a duration of a non-effective level of the second control signal.

12. The display device according to claim 10, wherein a time interval between a time interval between a starting edge of a non-effective level of the second control signal and the triggering edge of the second scan signal is equal to a time interval between a starting edge of a non-effective level of the first control signal and the triggering edge of the first scan signal.

13. The display device according to claim 10, wherein the first pixel circuit is coupled to a plurality of first pixel units, and the second pixel circuit is coupled to a plurality of second pixel units.

14. The display device according to claim 13, wherein the plurality of first pixel units are arranged one by one sequentially along the source line, and the plurality of second pixel units are arranged one by one sequentially along the source line.

15. The display device according to claim 14, wherein a number of the second pixel units coupled to the second pixel circuit is less than or equal to a number of the first pixel units coupled to the first pixel circuit.

* * * * *